United States Patent [19]

Gaskins

[11] 4,000,865

[45] Jan. 4, 1977

[54] CONTROLLED TENSION LET-OFF FOR UNWINDING ROLLS OF MATERIAL

[75] Inventor: Jack C. Gaskins, Lanett, Ala.

[73] Assignee: Batson-Cook Company, West Point, Ga.

[22] Filed: Aug. 27, 1975

[21] Appl. No.: 608,184

[52] U.S. Cl. ..... 242/75.43; 242/75.53

[51] Int. Cl.[2] ..... B65H 25/22

[58] Field of Search ..... 242/75, 75.4, 75.42, 242/75.43, 75.47, 75.5, 75.53, 45, 189; 28/35, 36

[56] References Cited

UNITED STATES PATENTS 3,811,637 5/1974 Abler ..... 242/75.43

*Primary Examiner*—Leonard D. Christian

*Attorney, Agent, or Firm*—Newton, Hopkins & Ormsby

[57] ABSTRACT

Controlled tension letoff apparatus for unwinding rolls of material includes a constant tension dancer roll operatively associated with the material being unwound, and a plurality of air pressure regulators, some of which emit variable control signals in response to the movement of the dancer roll and the tension sensed thereby while one of such regulators emits a constant control signal. The signals are fed into a computing air pressure relay, the output of which, in turn, impressed upon brake actuators associated with the material beam braking systems and in this manner, the braking level of the letoff beams is suitably controlled, so as to maintain constant the tension level of the material, in accordance with the movement of the dancer roll and the tension sensed thereby during the various operational modes of the system.

3 Claims, 1 Drawing Figure

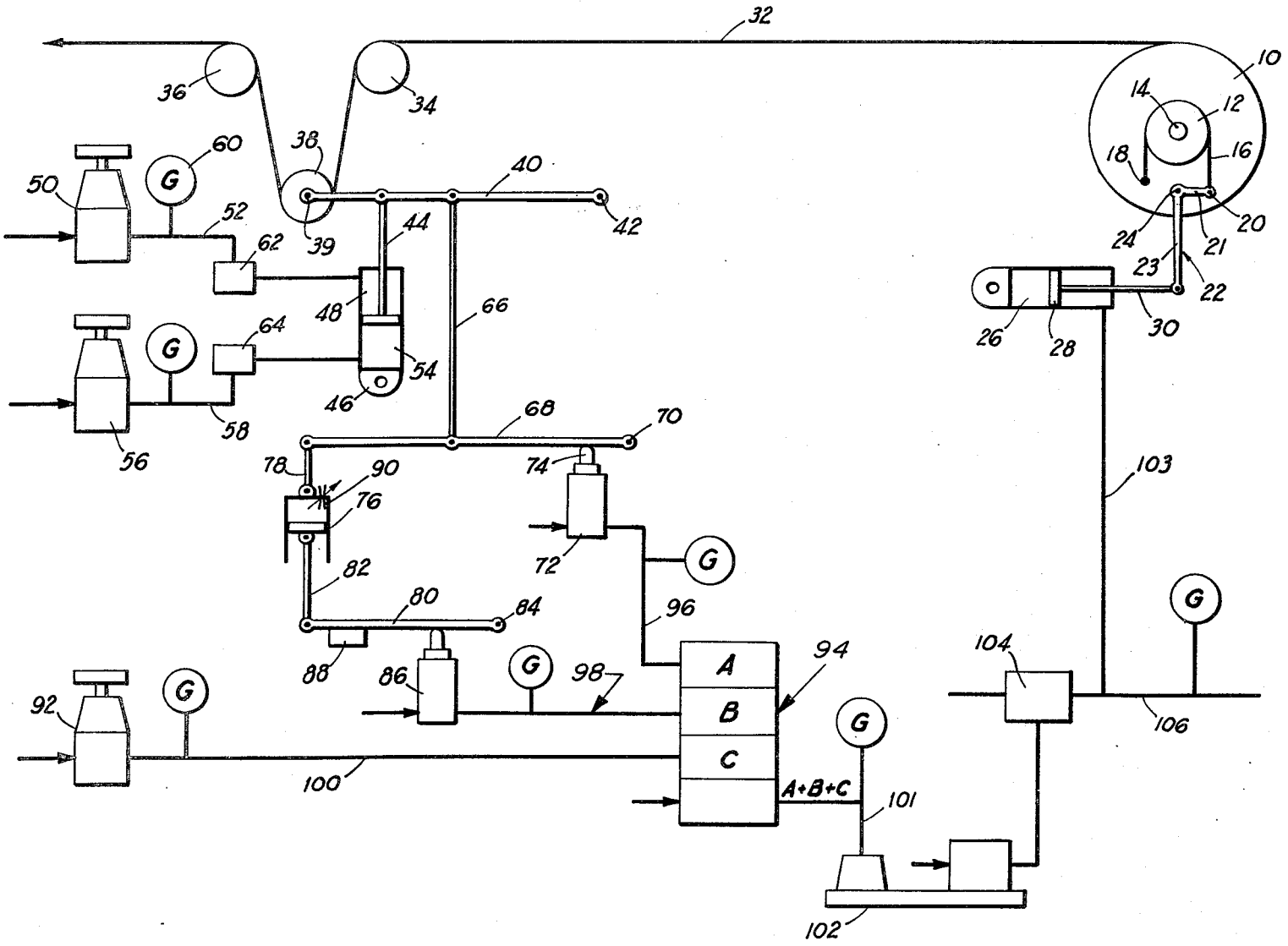
A
B
C
A+B+C
G

CONTROLLED TENSION LET-OFF FOR UNWINDING ROLLS OF MATERIAL

BACKGROUND OF THE INVENTION

1. Field of the Invention

The present invention relates generally to tension control apparatus and more particularly to an improved control apparatus which is able to maintain constant the letoff tension characteristic of a letoff beam of material throughout the starting, normal running, and stopping operational modes of the letoff beams during unwinding of the same.

2. Description of the Prior Art

In the preparation of warp for a loom, it is desirable to control the tension of the warp threads at a very low tension level or value and in addition, to maintain such tension level substantially constant, even during the starting and stopping operational modes of the slasher. Newer processing techniques however, have facilitated a considerable increase in slashing speeds such that the letoff braking systems conventionally employed within the apparatus can no longer maintain the letoff tension at the required values or levels.

In addition, it is well-known that the inertia characteristics of the letoff beams are such as to require that the braking of the letoff beams be in fact controlled in such a manner that the braking is reduced or rendered completely ineffective during acceleration periods, maintained constant during normal running periods during which the material is being transported at a substantially constant rate of speed, and increased during deceleration periods.

Furthermore, as the letoff beams are emptied, the effective braking levels must be reduced due to the fact that the radial distance of the wound beam material, from which the particular material is being unwound at a predetermined time, is constantly being reduced. Still further, the inertia characteristics of the letoff beams are constantly changing as the beams are emptied and this phenomenon continuously alters the braking requirements. It has been observed that conventional control apparatus simply cannot adequately control the tension levels required under such continuously changing and diverse conditions.

SUMMARY OF THE INVENTION

Accordingly, it is an object of the present invention to provide an improved tension control apparatus.

Another object of the present invention is to provide an improved tension control apparatus which overcomes the aforenoted drawbacks of conventional control apparatus.

Still another object of the present invention is to provide an improved tension control apparatus which is in fact able to maintain the tension level of the material being transported at a constant value, even during starting and stopping operational modes.

Yet another object of the present invention is to provide an improved tension control apparatus which is able to maintain the tension level of the material being transported at a constant value throughout the unwinding operation thereof including acceleration, normal running, and deceleration operational modes.

Yet still another object of the present invention is to provide an improved tension control apparatus which is able to compensate for the continuously changing inertia characteristics of the system.

The foregoing and other objectives are achieved according to the present invention through the provision of tension control apparatus which includes a constant tension dancer roll operatively associated with the material being unwound, and a plurality of air pressure regulators, some of which emit variable control signals in response to the movement of the dancer roll and the tension sensed thereby while one of such regulators emits a constant control signal. The signals are fed into a computing air pressure relay, the output of which is, in turn, impressed upon brake actuators associated with the material beam braking systems and in this manner, the braking level of the letoff beams is suitably controlled, so as to maintain constant the tension level of the material, in accordance with the movement of the dancer roll and the tension sensed thereby during the various operational modes of the system.

BRIEF DESCRIPTION OF THE DRAWING

Various other objects, features, and attendant advantages of the present invention will be more fully appreciated as the same becomes better understood from the following detailed description when considered in connection with the accompanying drawing, wherein:

THE SOLE FIGURE is a schematic diagram of the tension control apparatus constructed in accordance with the present invention and showing its cooperative parts.

DETAILED DESCRIPTION OF A PREFERRED EMBODIMENT

Referring now to the drawing, there is shown a controlled tension letoff apparatus for unwinding rolls of material wherein at least one beam of material 10 is rotatably mounted within support apparatus, not shown, and a brake drum 12 is fixedly secured upon the rotary shaft 14 of the beam. The drum 12 is of the pulley type and has associated therewith a brake cable 16 which is wrapped thereabout, one end 18 of the cable being secured to a non-rotatable support element, not shown, of the beam support apparatus, while the other end 20 is secured to one horizontally disposed leg 21 of a pivotable brake actuating linkage member, generally indicated by the reference character 22, having a generally L-shaped configuration. The linkage 22 is pivotable about a pin or axle 24 and the pivotal movement of the same is adapted to be controlled by means of a horizontally disposed pneumatic brake actuator, generally indicated by the reference character 26, of the piston and cylinder type, the piston 28 of which includes a piston rod 30 which is secured to the other, vertically disposed leg 23 of linkage member 22.

The material 32 wound upon beam 10 is directed or conducted about a pair of guide or idler rolls 34 and 36 as well as a dancer roll 38 which is interposed between rolls 34 and 36, and the material is then led off to a processing machine, not shown. The dancer roll 38 is fixedly secured to one end 39 of a dancer roll arm 40 which is pivotable about a pin or axle 42 so as to permit dancer roll 38 to reciprocate vertically, and arm 40 is also fixedly secured to the piston rod 44 of a vertically disposed piston and cylinder type dancer roll tension-loading actuator 46 which is similar to actuator 26.

The upper fluid chamber 48 of actuator 46 is fluidically connected to an air pressure regulator 50, through means of a conduit 52, which supplies a predetermined pressure to chamber 48 so as to properly regulate the load upon dancer roll 38 through means of piston rod 44, the loading of dancer roll 38 of course determining the tension normally impressed upon the web material 32. Similarly, the lower fluid chamber 54 of actuator 46 is fluidically connected to another air pressure regulator 56, through means of a conduit 58, which serves to supply a predetermined air pressure to chamber 54 so as to counterbalance the weight of the dancer roll assembly whereupon a pressure gauge 60, disposed within fluid conduit 52, may properly register the tension within the material 32. Quick exhaust valves 62 and 64 are respectively disposed within fluid conduits 52 and 58, such valves being similar to relief valves in that they are open to exhaust when the pressures within the system exceed predetermined values.

A vertically disposed linkage member 66 has one end thereof fixedly secured to dancer roll arm 40 while the other end thereof is similarly secured to a horizontally disposed lever 68 which is pivotable about a pin or axle 70. The right end portion of lever 68, as viewed in the drawing, is operatively associated with a plunger operated air pressure regulator 72 which is in fact disposed at a predetermined position along lever 68 such that the operative travel or movement range of dancer roll 38, as transmitted through linkage member 66, corresponds to the operative range of the vertically disposed plunger 74 of regulator 72. In this manner, the regulator 72 produces an air pressure signal which is proportional to the position of the dancer roll 38.

The left end portion of lever 68 is fixedly connected to the upper portion of a vertically disposed dashpot mechanism 76, through means of a suitable linkage member 78, while the lower portion of mechanism 76 is similarly connected with a horizontally disposed lever 80 through means of connecting linkage 82. Lever 80 is pivotably secured about a pin or axle 84 and the right end portion of the lever 80 is operatively associated with another vertically disposed plunger operated air pressure regulator 86 which is similar to regulator 72.

A weight 88 is adjustably mounted at a predetermined position upon the left end portion of lever 80 so that the lever acting upon the air pressure regulator 86 will establish a pressure output signal therefrom of 15 PSI when there is no loading impressed upon lever 80 by means of dashpot 76, it of course being appreciated that as the dancer roll 38 vertically reciprocates, the connecting linkage will transmit such reciprocal movement, through means of dashpot 76, so as to correspondingly increase or decrease the pressure output signal of regulator 86. Dashpot 76 also includes a variably adjustable air flow control valve mechanism 90 and as a result of the disposition of such structure within the dashpot mechanism, the latter is able to retain the pressure regulator 86, at an operative position displaced from its neutral position corresponding to an output of 15 PSI, for a period of time which is predetermined by the setting of the adjustable control valve 90.

An air pressure regulator 92, similar to pressure regulators 50 and 56, is provided in order to counteract the neutral output of 15 PSI of the plungeroperated regulator 86, and the three pressure output signals from regulators 72, 86, and 92 are respectively introduced into a computing air pressure relay 94 through means of conduits 96, 98, and 100. The signals from the regulators are combined within relay 94 in such a manner that the output thereof is equal to the sum of the signals issued from regulators 72 and 86 minus the signal value issued from regulator 92.

The resultant output signal from relay 94 is transmitted through means of a conduit 101 to an adjustable ratio air pressure regulator or relay 102 so as to be modified thereby and the modified output signal is in turn applied to the brake actuator 26 through means of a conduit 103, a quick exhaust valve 104, similar to valves 62 and 64, being disposed within conduit 103. The adjustable ratio air pressure regulator or relay 102 is utilized in order to set the braking level at a predetermined value such that the dancer roll 38 will be at its mid-stroke position during normal running of the unwinding apparatus. In this manner, the braking level may be increased or decreased as the dancer roll 38 moves upwardly and downwardly throughout the various operational modes of the apparatus. A manifold 106 may be operatively connected to fluid conduit 103 so as to transmit the resultant modified pressure signals to other brake actuators, not shown.

Obviously, many modifications and variations of the present invention are possible in light of the above teachings. It is to be understood therefore that within the scope of the appended claims the present invention may be practiced otherwise than as specifically described herein.

What is claimed as new and desired to be secured by letters patent of the United States is:

1. Apparatus for maintaining uniform tension within a web of material being unwound from a rotatable beam of material, comprising a signal responsive brake operatively associated with said beam of material for retarding the rotation of said beam of material in order to control said tension within said web of material, vertically reciprocating dancer roll means disposed in contact with said web so as to be responsive to a change in said tension of said web, a plurality of air pressure regulator means for emitting pressure control signals in response to the reciprocal movement of said dancer roll means, lever means interconnecting said dancer roll means and said air pressure regulator means for actuating said air pressure regulator means, dashpot means operatively associated with one of said air pressure regulator means for controlling said pressure control signal of said one of said air pressure regulator means for a predetermined period of time, computing relay means for receiving said signals of said plurality of air pressure regulator means and for transmitting a resultant signal to said brake for actuation thereof, pneumatic circuit means interconnecting said computing relay and said brake through which said resultant signal is transmitted, and adjustable ratio air pressure regulator means disposed within said pneumatic circuit means and interposed between said computing relay means and said brake for modifying said resulting signal of said computing means, whereby the braking level will have a predetermined value such that the dancer roll means will be at its mid-stroke position during normal running of said apparatus.

2. Apparatus for maintaining uniform tension in a web of material being wound or unwound from a rotatable beam of the material comprising a signal-responsive brake operatively connected with said beam to retard the rotation thereof to thereby control the tension in said web, a reciprocatory dancer roll disposed in contact with the web and being responsive to changes in web tension, movable linkage means connected with the reciprocatory dancer roll and actuated in response to reciprocal movement of the dancer roll, a pair of plunger type air pressure regulators operatively connected with said linkage means, an additional air pressure regulator for emitting a pressure control signal of constant value and equal to the signal of one of said pair of plunger type regulators, a summation air pressure relay having a separate connection with each of said pair of regulators and said additional regulator and receiving signals therefrom and transmitting a resultant signal to said signal-responsive brake, and pneumatic circuit means interconnecting said summation relay and said brake through which said resultant signal is transmitted.

3. The apparatus as set forth in claim 2, and a pneumatic actuator means connected with said dancer roll for establishing a tension of predetermined value in said web.

* * * * *